United States Patent [19]

Knowlton et al.

[11] 4,206,001

[45] Jun. 3, 1980

[54] CLEANING METHOD FOR REFINING PROCESS RUNDOWN TANK

[75] Inventors: Harold E. Knowlton, Moraga, Calif.; Raymond A. Petrick, Ocean Springs, Miss.

[73] Assignee: Chevron Research Company, San Francisco, Calif.

[21] Appl. No.: 920,917

[22] Filed: Jun. 30, 1978

[51] Int. Cl.[2] ..... B08B 3/08; B08B 3/10; B08B 9/08

[52] U.S. Cl. ..... 134/12; 134/22 R; 134/26; 134/34; 134/40; 210/73 W

[58] Field of Search ..... 134/10, 12, 21, 22 R, 134/34, 26, 40; 210/73 W, 83; 208/13; 71/9, 25; 405/129

[56] References Cited

U.S. PATENT DOCUMENTS

| | | | |
|---|---|---|---|
| 2,715,594 | 8/1955 | Garrison | 134/22 R |
| 3,536,529 | 10/1970 | Fiocco | 134/40 |
| 3,600,296 | 8/1971 | Rieve | 208/13 |
| 3,716,480 | 2/1973 | Finley et al. | 210/73 W |
| 4,014,780 | 3/1977 | McCoy | 208/13 |

*Primary Examiner*—Richard V. Fisher

*Attorney, Agent, or Firm*—R. L. Freeland, Jr.; G. W. Wasson

[57] ABSTRACT

A method is described for cleaning nonsettling oil-solid mixtures from the bottom of catalytic cracking rundown tanks wherein a solvent of particular specifications is introduced in the rundown tank and circulated around, in and through the non-settling oil solids with an angularly adjustable pump. After the floating oil-solid mixture has been separated by the solvent, the solvent and liquid are removed from the tank, separated and recycled to process streams. The remaining settled solid sediments may then be washed with an aqueous solution circulated in the tank with the adjustable pump to water-wash additional oils from the solid sediments, and the aqueous solution and oils carried therewith are removed from the tank and separated. The remaining solid materials are then vacuumed from the tank or water-washed from the tank to complete the cleaning process initiated totally from outside of the tank.

11 Claims, 3 Drawing Figures

CLEANING METHOD FOR REFINING PROCESS RUNDOWN TANK

BACKGROUND OF THE INVENTION

Fluid catalytic cracking (FCC) processes involve the interaction of a feedstock and a catalyst flowing through a reactor. Cracking of the feedstock occurs in the reactor at temperatures usually in the range of 890° to 970° F. resulting in a coke build-up on the fluid catalyst. The "spent" catalyst is processed to remove occluded oil and regenerated to be recycled to the process stream. The cracked oil is passed to a fractionator where gas, light oil and heavy oil products are separated, the heaviest and highest-boiling oils—fractionator bottoms—contain some catalyst fines and are routed back to the FCC reactor or to a settling tank for fines removal prior to use of this heavy oil in fuel oil or as carbon black feedstock.

The fractionator bottom oils containing catalyst fines are usually routed to a "rundown" tank where solid particles, mostly catalyst fines, are partially settled by gravity action, the top-most layer of oil in the tank is decanted off for product use. Near the bottom of the tank is a floating oil/solid mixture which is substantially impossible to separate by gravity settling. Eventually there builds up a large sticky mass of heavy fluid-coated floating oil/solids which accumulate in the rundown tank. It then becomes necessary to clean out the tank bottom and dispose of this waste. Rundown tanks commonly in use are as large as 100 to 150 feet in diameter, 30 to 50 feet in height, and can contain up to 10 feet of floating oil/solids and other sediments in the bottom.

Past practice has been to place personnel and equipment inside the tank and physically remove the floating oil/solid sediments to exterior equipment. The solid materials have been transported to "landfarming", landfills, or other treatment-disposal. The "landfarming" process consists of controlled application and cultivation of wastes on soil, on a properly engineered site, in order to use microbes naturally present in the soil to decompose the organic fraction of the wastes.

The past practice process has been extremely time-consuming both in physically removing the sediments from the rundown tank and in biological decomposition of the large volumes of oil containing high-boiling polynuclear aromatics. Further, land-farming or landfill areas are becoming scarce, and are frequently separated some distances from the refinery location. A more efficient and environmentally safe cleaning process has therefore been needed.

The present invention is of increasing importance because of recent toxic laws and OSHA restrictions on all aspects of the petroleum industry. FCC fractionator bottoms are recognized as containing polynuclear aromatics. Because the method of present invention can be accomplished totally from outside of the tank involved, the method may be considered as a substantially environmentally safe process.

While the foregoing has referred specifically to an FCC process, it should be understood that the invention applies to any process where a rundown tank collecting sticky solids is likely to be encountered.

BRIEF DESCRIPTION OF THE INVENTION

In light of the foregoing described need, the present invention provides an efficient means for cleaning the bottom of an FCC rundown tank in a manner to substantially recover all valuable process fluids and minimize the area needed for landfarming or landfill of oily solid materials while accomplishing both objectives from the exterior of the rundown tank in an environmentally safe manner without contact with the settled materials. In the present process, a selected solvent having particular characteristics is introduced into the rundown tank and circulated in, through and around the floating oil/solid materials for a sufficient period of time to accomplish contact with all sediments in all portions of the tank. The solvent is circulated by a pump inserted through or installed in a man-way or entry port. The pump is adapted to be adjustably directed within the tank so as to direct its pump force to all portions of the tank and its bottom. The solvent material is selected from the light hydrocarbon class and is preferably a kerosene-like stock such as jet aviation fuel or a selected refinery stock with high Reid vapor pressure (RVP) preferably in the range of 15 p.s.i. to 0.1 p.s.i. as determined by ASTM D-323 test procedure, and a desirable density difference from the hydrocarbons in the oil/solids materials. The solvent should have an API gravity in the range of 30 to 80.

After adequate circulation of the solvents in the rundown tank and after allowing for gravity separation, the fluids portions are withdrawn from the tank, the solvent and other hydrocarbon compounds separated and returned to the refinery process streams and the solids are left in the tank. An additional circulation and washing with an aqueous solution will further remove hydrocarbon materials from the solids in the tank to produce substantially clean, dry solids for removal. Solids are then removed from the tank and disposed of in any desirable manner. These solids are substantially clean and dry, and contain very little residual petroleum materials compared to the original oil/solid material. Remaining solids have been measured as containing only 3% hydrocarbons or less by incineration.

All of the above can be accomplished without putting personnel and equipment inside the rundown tank, except in the event of needed repair after cleaning has been completed, and without requiring large landfarming or landfill areas. The solvent is selected to be compatible with the safety requirements of the refinery and, because it is confined within the rundown tank, it is not exposed to the exterior environment. The extracted liquid materials are separable to recover the solvent, and the fractionator bottoms oils may be returned to the process stream or consumed as a fuel in process furnaces. The solids are substantially clean and dry and are acceptable as solid landfill or as landfarming material.

OBJECT OF THE PRESENT INVENTION

The object of the present invention is to provide an efficient and environmentally safe method to clean the floating oil/solid sediment materials in an FCC rundown tank totally from the exterior of the tank.

Another object is to provide a method for separating solid and liquid materials in an FCC rundown tank to permit liquids to be returned to refinery process streams and the recovery of scarce and costly petroleum hydrocarbons.

A further object of the present invention is to provide a method for cleaning sediments from the bottom of an FCC rundown tank, or equivalent, so as to produce solids that may be disposed of safely in landfarming or landfilling operations.

Further objects and features will be readily apparent from the following specification and the appended claims.

DESCRIPTION OF THE PREFERRED EMBODIMENT OF THE INVENTION

Figure 1:
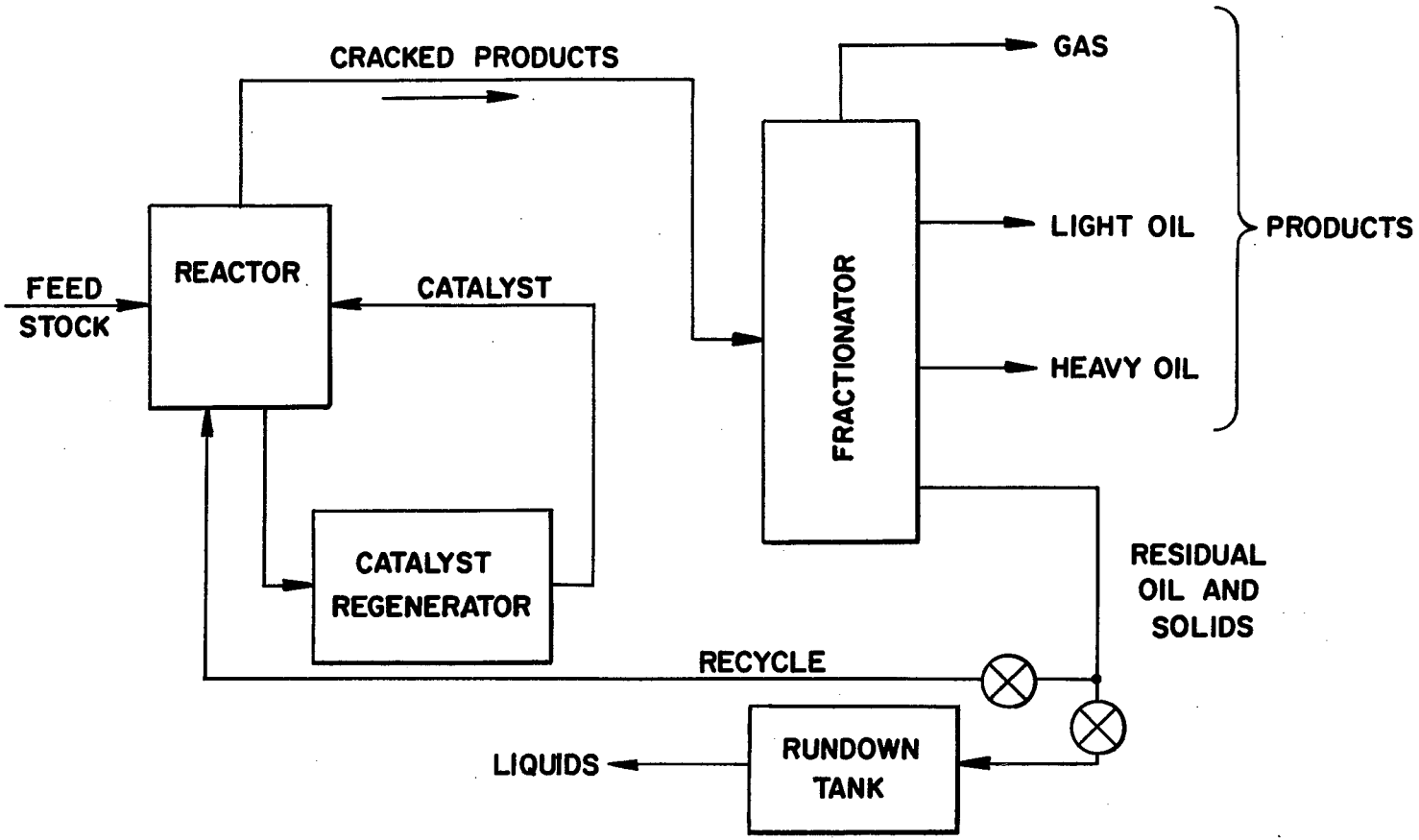
FIG. 1 is a flow diagram illustrating a refining process wherein a rundown tank is employed and wherein the method of the present invention could be used.

FIG. 1 is a flow diagram of a simplified FCC refining process. As illustrated, a reactor 11 has feed 12 of a petroleum crude stock and a catalyst 13. Within the reactor the feedstock is subjected to process conditions of elevated temperature and sometimes elevated pressure in the presence of a catalyst to accomplish the desired cracking. Within the reactor the crude feed and the catalyst encounter each other, and at the temperature and pressure involved some coking of the catalyst occurs. The coked catalyst is regenerated in catalyst regenerator 14 and recycled to the reactor. The cracked products pass from the reactor 11 to a fractionator 15 where the many products within the cracked products are separated into boiling ranges of gas, light oils, heavy oils and fractionator bottoms.

The fractionator bottoms oils include some heavy petroleum base materials and solids including some catalyst fines. These materials may be recycled or passed to a rundown tank 16, where solids and liquids are gravity-separated and the decanted liquids are passed to other processes or furnaces as feed.

In FCC and some other refining processes, the rundown tank contains a dense layer of floating oil/solid mixture (mostly catalyst fines and fractionator bottoms) which settles in the rundown tank over extended periods of operation and can accumulate to a substantial depth, thus both eliminating some available storage capacity and presenting a solid waste disposal problem. The present invention eliminates both of these problems by separating the truly solid materials from the soluble liquid materials in a simple and efficient method performed from the exterior of the rundown tank.

Figure 2:
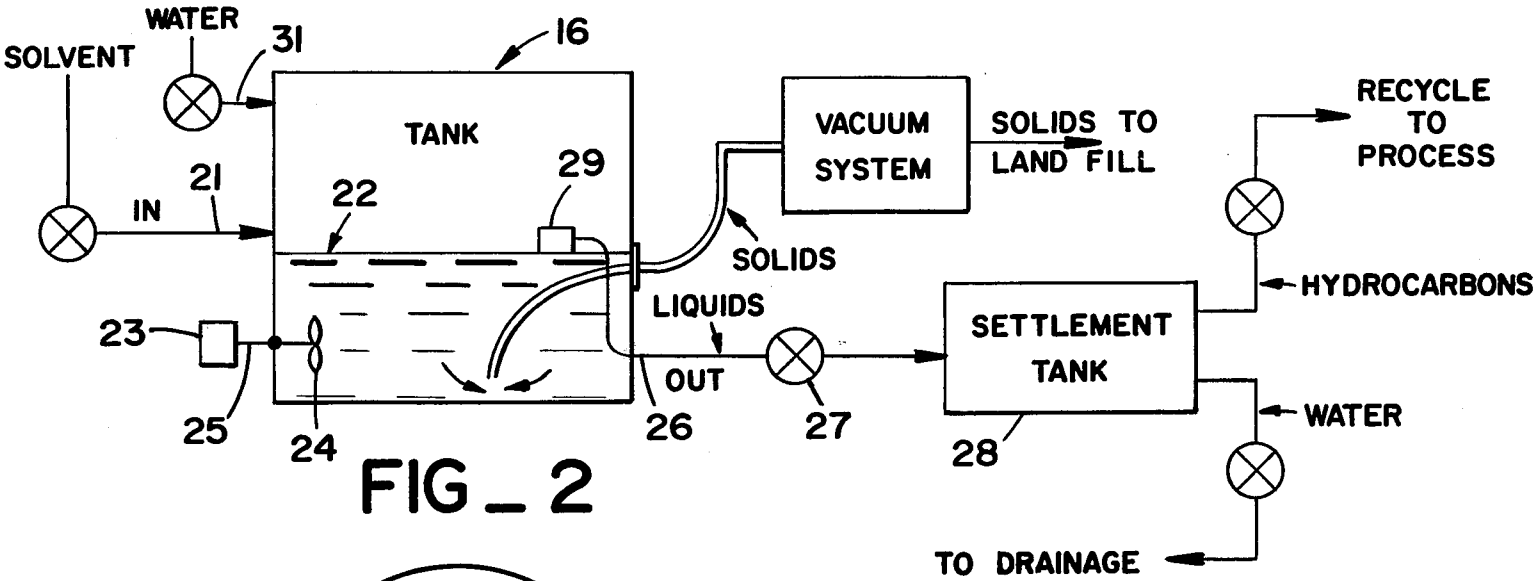
FIG. 2 is a schematic diagram illustrating the method of the present invention.
Figure 3:
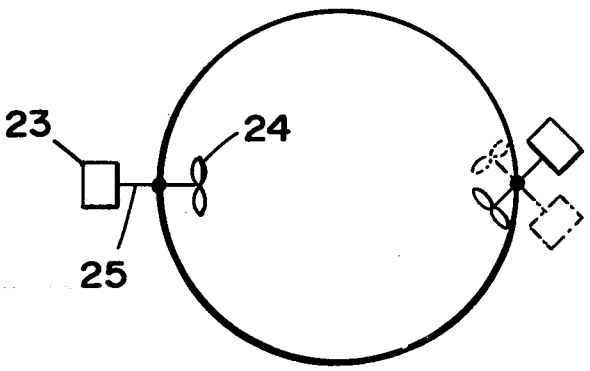
FIG. 3 is a plan view of a tank illustrating the adjustable characteristic of the pump used with the present invention.

As illustrated in FIG. 2, solvent is introduced at 21 to the rundown tank 16 to a level to permit intimate contact with the residue 22 in the bottom of the tank. A circulating pump or mixer 23 with elements such as blades or a nozzle 24 inside the tank is permanently installed in the tank or inserted through an available entry port. The shaft 25 of the pump or mixer passes through a seal that permits adjustment of the angle of the elements 24 within the tank about a vertical axis so as to permit direction of the action of the pump or mixer toward all portions of the tank and its bottom. A mixer of this type is manufactured by Jensen International, Inc., Tulsa, Okla., and sold as a Jensen Vari-Angle Mixer.

More than one pump or mixer 24 may be employed around the periphery of the tank to insure adequate mixing of the solvent in, around and through the sediments 22 in the tank.

The solvent should be introduced to a depth such that when circulated by a pump it will not cavitate in the tank, possibly forming a froth or emulsion.

Mixing in that manner is continued until all floating oil/solid mixtures have been stirred and contacted with the solvent. The nature of the sediments in an FCC rundown tank have shown that mixing may continue for as many as 3 to 15 days.

The preferred solvent employed in the present method is a product readily available in most refineries. A product having an API gravity between 30 and 80 and a Reid vapor pressure between 15 p.s.i. and 0.1 p.s.i. is suggested, with kerosene jet aviation fuel preferred. Light straight-run products are also suggested. The solvent should be compatible with the dense floating oil/solid mixture and should be substantially non-hazardous in the refinery environment where the rundown tank is located. Again, kerosene jet aviation fuel meets those specifications.

After adequately mixing, the fluid mixed content of the rundown tank is decanted through line 26 and valve 27 to settlement tank 28. To avoid, as much as possible, decanting solids with fluids, the line 26 is connected to a floating collector 29 on the surface of the fluids within tank 16. Before or after passing through the settlement tank 28, the fluid stream may pass through a conventional API separator, as is common practice in a petroleum refinery. The essentially solid-free hydrocarbons can then be used as feed to a process stream or as fuel. Any harmful materials carried with the liquid extracted from the rundown tank are thus disposed of in a process stream or furnace.

At this point in the method, the solvent mixing process may be repeated if necessary to adequately contact all solids in the residue in the rundown tank. A simple visual observation will permit one reasonably skilled in refining operations to conclude whether repeated solvent mixing is required.

After solvent mixing has been completed, an aqueous solution may be introduced at 31 to the rundown tank and mixed with the remaining solids to remove any additional hydrocarbon materials that remain on the solids and that are immiscible with the water base. After adequate mixing, again for as much as days, the liquid material may be withdrawn through line 26 and passed to the settlement tank 28 where the aqueous and hydrocarbon phases may be permitted to separate. When separated, as shown in FIG. 2, the hydrocarbons may be recycled to the process stream feed or furnace fuel and the water-base portions passed to the refinery drainage system for further treatment before return to the refinery water system or the environment.

After solvent and water-washing has been completed, the rundown tank may be cleaned of settled solids by a conventional vacuum system introduced through an access port or by a water nozzle put into the man-way or port and washing the solids out of the tank. The solids removed at this time have been substantially separated from the liquids of the FCC process. The cleaned solids are essentially free of harmful elements and can be recycled to the catalyst recovery system, if they meet the catalyst specifications, or can be used as landfill where clean landfill is acceptable, or landfarmed if this is desirable.

The entire tank-bottom cleaning process of the present invention is initiated from the exterior of the tank in a manner that provides utmost safety to personnel and equipment in the refinery environment. Whereas prior tank-bottom cleaning schemes have required placing both personnel and equipment inside the tank, the present method has avoided that hazardous operation. Furthermore, the experience has shown that the method not only produces a substantially clean, dry solid waste and recovers a valuable energy source previously wasted, but also has reduced the total manpower requirements substantially and the total downtime of the rundown tank from the process cycle.

Representative time and manpower requirements by the present method and the known prior art methods show:

| | Cleaning of a 50,000-Barrel Tank | |
|---|---|---|
| | Present Method | Prior Art |
| Manpower | 20 man days | 120 man days |
| Over-all time required | 2 weeks | 6 weeks |

While a certain preferred embodiment of the present invention has been specifically disclosed, it is to be understood that the invention is not limited thereto, as many variations will be readily apparent to those skilled in the art and the invention is to be given its broadest possible interpretation within the terms of the following claims.

What is claimed is:

1. A method for cleaning a catalytic cracking process rundown tank wherein fractionator bottoms oils from catalytic cracker FCC fractionator column including process fluids having catalyst fines suspended therein flowed into said rundown tank and heavy, liquid-coated solids are accumulated as a sticky mass of floating sediments in the bottom of said rundown tank, the steps comprising:

(a) flowing a hydrocarbon liquid solvent into said rundown tank to a depth in said tank to more than cover the entire volume of said sticky floating mass;

(b) circulating said hydrocarbon liquid solvent through said accumulated sediments in a manner to contact the sticky floating mass and substantially the entire interior bottom of said tank while avoiding cavitation of said circulated hydrocarbon liquid;

(c) decanting liquid from said tank to a process stream in a manner to leave solid sediments in said tank, (d) flowing an aqueous solution into said tank to separate remaining hydrocarbon liquid from said solid sediments, (e) decanting said aqueous solution and hydrocarbon liquid from said tank and separating hydrocarbon liquid from said aqueous solution, (f) and removing said solids sediments from said tank to accomplish said desired tank cleaning.

2. The method of of claim 1 wherein all of said steps are initiated from outside of said rundown tank and wherein no human physical presence is required inside said rundown tank.

3. The method of claim 1 wherein said hydrocarbon liquid solvent has an API gravity of between 30 and 80.

4. The method of claim 1 wherein the Reid vapor pressure of said hydrocarbon liquid solvent is between 15 psi and 0.1 psi.

5. The method of claim 1 wherein the hydrocarbon liquid solvent is kerosene jet aviation fuel.

6. The method of claim 1 wherein the decanted liquid of step (c) is further separated in a process stream to return said hydrocarbon liquid to process feed and said catalytic cracking fractionator bottoms oils separated from said solids are blended with process fuel oils.

7. The method of claim 1 wherein said solids are removed from said rundown tank with a vacuum means passed into said rundown tank through an access port.

8. The method of claim 1 wherein solids are removed from said rundown tank with a water stream inserted through an access port and solids are carried with water flowing out of said tank.

9. The method of claim 1 wherein said removed solids are passed to landfarming, landfill or other disposal method.

10. The method of claim 1 wherein steps (a), (b) and (c) are repeated until said sticky floating mass is separated into liquid and settleable solids.

11. The method of claims 1 or 6 wherein said decanted liquid is fed to a distillation column to recover said hydrocarbon liquid solvent as overhead product.

* * * * *